US009193176B2

(12) United States Patent
Kohrs et al.

(10) Patent No.: US 9,193,176 B2
(45) **Date of Patent: *Nov. 24, 2015**

(54) SYSTEMS AND METHODS FOR PRINTING INDICIA ON LATEX SURFACES IN MOTION

(71) Applicant: Condomnation LLC, Marietta, GA (US)

(72) Inventors: Clive Kohrs, Ballito (ZA); Brandon Kohrs, Ballito (ZA)

(73) Assignee: Condomnation LLC, Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/474,240

(22) Filed: Sep. 1, 2014

(65) Prior Publication Data

US 2014/0368595 A1 Dec. 18, 2014

Related U.S. Application Data

(63) Continuation of application No. 13/749,040, filed on Jan. 24, 2013, now Pat. No. 8,851,592.

(60) Provisional application No. 61/590,147, filed on Jan. 24, 2012.

(51) Int. Cl.
*B41J 3/00* (2006.01)
*B41J 3/407* (2006.01)

(52) U.S. Cl.
CPC ..... *B41J 3/4073* (2013.01)

(58) Field of Classification Search
USPC ..... 347/4, 5, 8, 10, 12, 13, 16, 37–40; 523/160, 161
See application file for complete search history.

(56) References Cited

U.S. PATENT DOCUMENTS

| | | | |
|---|---|---|---|
| 2,221,711 | A | 11/1940 | Kurkjian |
| 2,609,094 | A | 9/1952 | Fry |
| 3,843,570 | A | 10/1974 | Murayama |
| 5,158,606 | A | 10/1992 | Carlick et al. |
| 5,284,159 | A | 2/1994 | Wilk |

(Continued)

FOREIGN PATENT DOCUMENTS

| | | | |
|---|---|---|---|
| CN | 2907584 | Y | 10/2005 |
| EP | 316659 | A2 | 5/1989 |

(Continued)

OTHER PUBLICATIONS

Gateway.cn, "LED UV FB3328, condom printer pvc sheet digital flatbed printer plastic bag printer direct print on cover," website visited and listing printed Apr. 23, 2015; pp. 1-6 (www.alibaba.com).

*Primary Examiner* — Hai C Pham

(57) ABSTRACT

Devices, systems, and methods for printing indicia on latex are presented. A system for printing includes a latex surface supported by a mold on a rotary mount, a printer, a base plate supporting print heads, a rotational drive system for selectively rotating the mold during printing, and a printer engine programmed to print indicia onto a substantially contiguous area of the latex surface, from an intermediate border to and including a distal end. In a system with multiple molds moving along a path, the system may include a chassis for supporting the base plate, printer, and/or rotational drive system, and a motion controller for moving the chassis near the molds. Latex articles may be imprinted with indicia that is decorative and/or informative.

30 Claims, 7 Drawing Sheets

(56) References Cited

U.S. PATENT DOCUMENTS

| | | | | |
|---|---|---|---|---|
| 5,749,949 | A | 5/1998 | Tavares | |
| 5,853,859 | A | 12/1998 | Levy et al. | |
| 5,854,306 | A | 12/1998 | Mattesky et al. | |
| 6,145,506 | A | 11/2000 | Goll | |
| 6,318,154 | B1 | 11/2001 | Povlacs et al. | |
| 6,632,471 | B2 | 10/2003 | Krause et al. | |
| 6,828,399 | B2 | 12/2004 | Lee | |
| D525,357 | S | 7/2006 | Barrett | |
| 7,629,410 | B2 | 12/2009 | Westerman et al. | |
| 7,967,414 | B2 | 6/2011 | Schmitt | |
| 8,851,592 | B2 * | 10/2014 | Kohrs et al. | 347/4 |
| 2003/0124354 | A1 | 7/2003 | Vistins | |
| 2004/0157957 | A1 | 8/2004 | Ganapathiappan et al. | |
| 2004/0197531 | A1 | 10/2004 | Vincent et al. | |
| 2006/0279619 | A1 | 12/2006 | Anderson et al. | |
| 2007/0002094 | A1 | 1/2007 | Kim et al. | |
| 2007/0231525 | A1 | 10/2007 | Bodwell et al. | |
| 2008/0142021 | A1 | 6/2008 | Hook | |
| 2011/0041856 | A1 | 2/2011 | Mistler | |
| 2014/0109917 | A1 | 4/2014 | Nguyen et al. | |

FOREIGN PATENT DOCUMENTS

| | | | |
|---|---|---|---|
| JP | 01-150573 | | 6/1989 |
| WO | WO 2004014266 | A1 | 2/2004 |
| WO | 2006081817 | A1 | 8/2006 |

* cited by examiner

SYSTEMS AND METHODS FOR PRINTING INDICIA ON LATEX SURFACES IN MOTION

CROSS-REFERENCE TO RELATED APPLICATIONS

This application is a continuation of application Ser. No. 13/749,040, entitled "Latex Articles Imprinted With Full-Length Indicia And Systems And Methods For Imprinting Latex Articles," filed Jan. 24, 2013, currently pending, which claims the benefit of and U.S. Provisional Application No. 61/590,147, entitled "Latex Articles Imprinted With Full-Length Indicia And Systems And Methods For Imprinting Latex Articles," filed Jan. 24, 2012. Each application identified above is incorporated herein by reference in its entirety in order to provide continuity of disclosure.

BACKGROUND

Described herein is a system and method for printing indicia on a latex surface; for example, on a multi-layer latex condom.

Plain condoms are boring. Variations in condom shape, texture, and color have not sufficiently increased consumer interest in the use of condoms, especially among young people. Thus, there is a need in the art for manufacturing a more appealing and interesting latex condom.

There is also a related need in the art for safely printing any of a variety of indicia onto the latex surface of any of a variety of products, including those intended for medical uses.

SUMMARY

A system for printing indicia on latex, according to various embodiments, includes: (1) a latex surface supported by a mold, wherein the mold is supported at its proximal end by a rotary mold mount that allows rotation about the longitudinal axis, and wherein the mold is driven along a first path at a first velocity; (2) a printer comprising one or more print heads and a printer engine; (3) a chassis supporting a base plate that is sized and shaped to extend along the latex surface, the base plate defining a plurality of ports therethrough, each sized and shaped to receive one of the one or more print heads; (4) a rotational drive system for selectively rotating the mold about the longitudinal axis; and (5) a motion controller in communication with the printer engine, wherein the motion controller positions the base plate near the latex surface by moving the chassis to a location along the first path near the mold and by maintaining the chassis at a second velocity substantially equivalent to the first velocity, wherein the printer engine activates the one or more print heads, in coordination with the rotational drive system, such that indicia is printed onto the latex surface.

A method of printing indicia on latex, according to various embodiments, includes: (1) providing a mold for supporting a latex surface, wherein the mold is supported at its proximal end by a rotary mold mount that allows rotation about the longitudinal axis, and wherein the mold is driven along a first path at a first velocity; (2) providing a printer near the latex surface, the printer comprising one or more print heads and a printer engine; (3) positioning a chassis near the latex surface, the chassis supporting a base plate that is sized and shaped to extend along the latex surface, the base plate defining a plurality of ports therethrough, each sized and shaped to receive one of the one or more print heads; (4) selectively rotating the mold about the longitudinal axis using a rotational drive system; (5) positioning the base plate near the latex surface using a motion controller in communication with the printer engine to move the chassis to a location along the first path near the mold and to maintain the chassis at a second velocity substantially equivalent to the first velocity; and (6) printing indicia onto the latex surface by activating the printer engine, in coordination with the rotational drive system.

BRIEF DESCRIPTION OF THE DRAWING

Features of the various embodiments disclosed will become more apparent in the detailed description, in which reference is made to the appended drawings, wherein.

DETAILED DESCRIPTION

Figure 1:
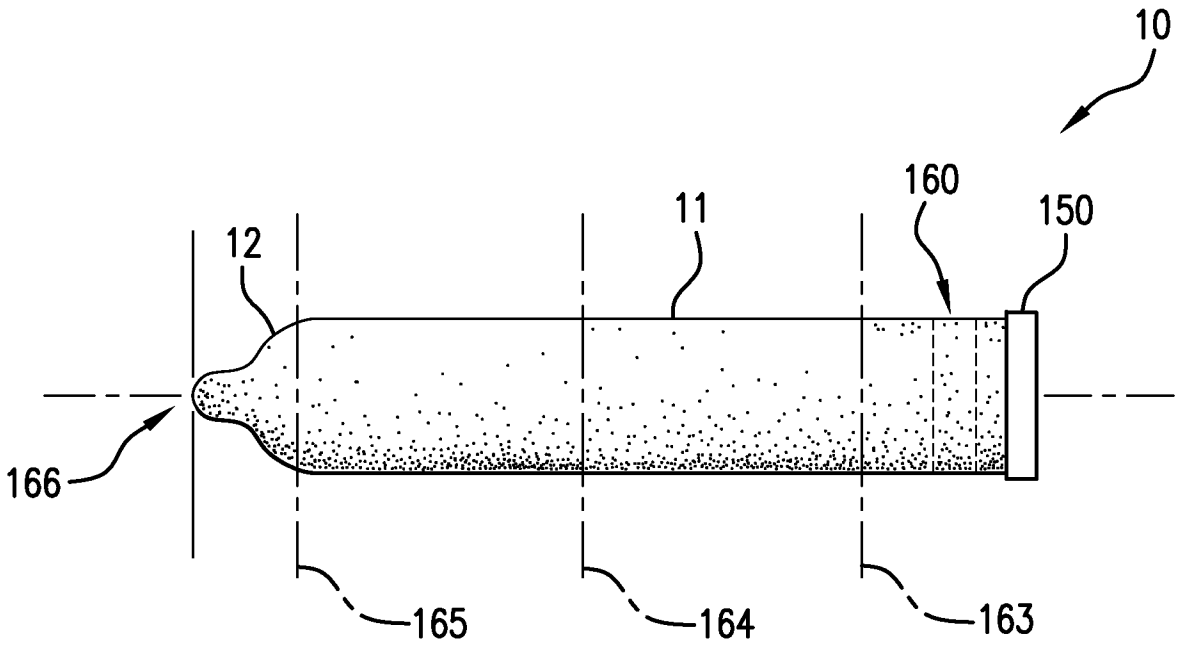
FIG. 1 is an illustration of a glass mold in a generally horizontal orientation, according to various embodiments.

The present systems and apparatuses and methods are understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to a component can include two or more such components unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The words "proximal" and "distal" are used herein to describe items or portions of items that are situated closer to, and away from, respectively, a particular end of a component or structure. Thus, for example, the tip or free end of a component may be referred to as the distal end, whereas the generally opposing end (near the base of a component, for example) may be referred to as the proximal end.

Materials and Products

Although the systems, methods, and products are discussed in the context of latex condoms, the technology disclosed herein is also useful and applicable to condoms made of any of a variety of other materials, both natural and synthetic, including materials such as polyurethane, polyisoprene, and resins. The technology disclosed herein is also useful and applicable to other products, made of any material, including but not limited to finger cots, surgical gloves, surgical drapes, household gloves, balloons, implantable and temporary catheters, bandages, dental cofferdams, adhesive tape, elastic bands, electrode pads, drains, all kinds of tubing and tips, rubber pads, fluid-circulating warming blankets, tourniquets, airways, breathing bags, all types of hoses and bellows, injection ports and intravenous tubing.

Dipping Line

A typical dipping line for manufacturing latex condoms may include a plurality of glass molds 10 mounted on a chain or other conveyor and driven by a main drive system. The main drive system may include a variable-velocity electric motor that controls the velocity of the line. The chain may include specialized brackets that are capable of moving the glass molds 10 between a generally horizontal orientation and a generally vertical orientation, as desired, at different locations along the dipping line. The glass molds 10 are sized and shaped according to the desired shape of the finished condoms. In some systems, the chain is substantially continuous, permitting the plurality of glass molds 10 to be used repeatedly in a circuit that typically includes a station for washing and drying the glass molds between uses.

In a first step, the clean glass molds 10 may pass through a first dip tank filled with a liquid latex compound. The glass molds 10 are typically in a vertical lengthwise orientation as they pass through the first dip tank. The latex adheres to the glass molds 10 forming a first layer. When the glass molds 10 emerge from the first dip tank, the latex begins to dry. The line may include a first oven to accelerate or otherwise control the drying process. The glass molds 10 are typically in a horizontal orientation as they pass through the first oven.

Additional dips into tanks of latex may be used in order to increase the thickness of the condom. The amount of water in the latex and other factors also affect the final thickness. The glass molds 10 may pass through a second latex dip tank, in a vertical lengthwise orientation, forming a second layer 41 of latex. A second oven may be used to accelerate or otherwise control the drying process. The glass molds 10 are typically in a horizontal orientation as they pass through the second oven. Next, a beading station may include brushes that roll the open, circumferential edge of the latex in order to form a circumferential bead at the open end of the condom. The glass molds 10 may pass through one or more additional ovens before the dried latex condoms are stripped off the glass molds 10. The finished condoms may be rinsed, dried, and otherwise prepared for final packaging. The glass molds 10 are then cleaned and dried in preparation for another use.

Printing System

A system 100 for printing indicia on latex, in various embodiments, may include a plurality of glass molds 10 for supporting a latex surface, a printer 110, and a printer engine 200 for printing desired indicia onto the latex surface.

As shown in FIG. 1, each glass mold 10 in various embodiments may include a generally cylindrical body 11 and a bulbous end 12. The glass mold 10 may be supported by a rotary mold mount 150 that is mounted on a chain (not shown) or other support, and driven along a main path known as a dipping line. The rotary mold mount 150 supports and allows rotation of each glass mold 10 about its generally longitudinal axis, as illustrated in FIG. 1.

Each glass mold 10 in various embodiments may include a proximal portion 160 around its circumference near the proximal end or base of the mold 10, as shown in FIG. 1. As described below, a component such as a wheel or a belt may be used to impart rotational motion to the glass mold 10 by engaging with the proximal portion 160. Also, each glass mold 10 may be characterized as having one or more circumferential reference planes. As illustrated in FIG. 1, these planes may include a proximal plane 163, an intermediate plane 164, and a distal plane 165. The proximal plane 163 may be referred to herein as a circumferential border around the cylindrical body 11 at a proximal plane. The distal plane 165 may be located near the end of the cylindrical body 11 of the mold. Each glass mold 10 may also be characterized as having a tip or tip point 166 near its free end or distal end, as shown in FIG. 1.

The printer 110 in various embodiments may be an inkjet printing system that includes a set of ink reservoirs, a set of print heads with nozzles, and a printer engine 200 that drives one or more controllers to position and control the various components of the printing system 100 during the printing process. The printer 110 may include piezoelectric drop-on-demand print heads that deliver a drop of ink through a selected nozzle. The set of ink reservoirs may include any of a variety of colors. The ink in various embodiments may be a latex-based ink with a relatively quick drying time.

Figure 6:
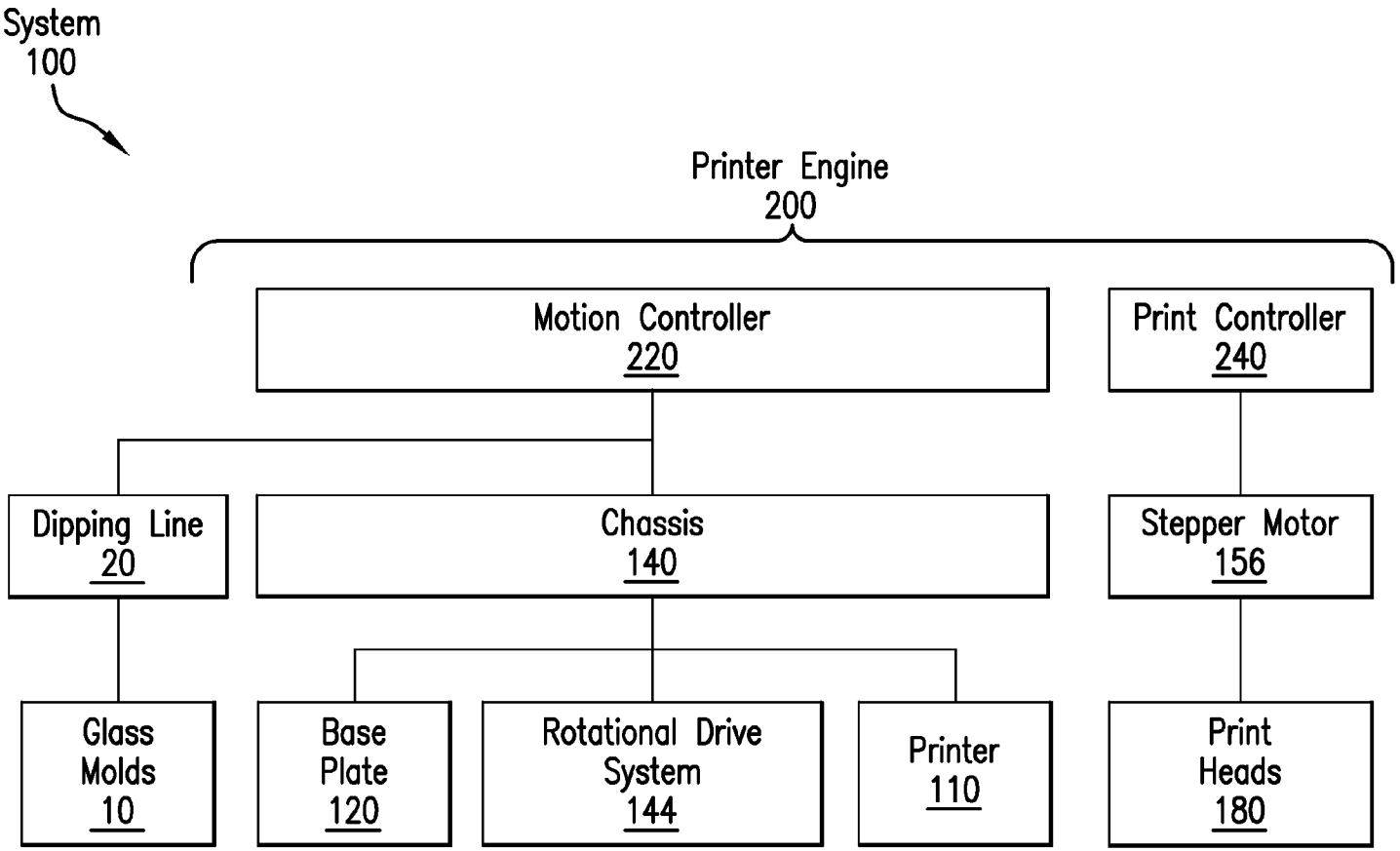
FIG. 6 is a schematic illustration of printer engine, according to various embodiments.

The printer 100 may be driven by a software program product referred to generally as a printer engine 200, which may be programmed to control all aspects of the print process. The printer engine may include a motion controller 220 and a print controller 240, as shown schematically in FIG. 6. The motion controller 220, as described herein, may be used to control the motion of the dipping line 20 and a chassis 140, described below. The print controller 240 may coordinate and control the set of ink reservoirs 115, the set of print heads 180, and a stepper motor 156 during the print process. The stepper motor 156, as described below, may be used to control the rotation of the latex surface during printing.

The printing system 100 described herein may be used to print indicia onto a substantially contiguous area of a latex surface, without overlapping. As described herein, a substantially contiguous area means that the indicia is imprinted in an unbroken, uninterrupted manner. Of course, certain indicia such as text will have blank spaces between the letters, and between the text and the outer borders of the image. In this aspect, the indicia need not include a continuous deposit of ink across the entire image; however, the indicia as described herein is imprinted onto a substantially contiguous area.

The indicia, for example, may be a digital image such as a photograph. Any of a variety of images, including photographs, may be scanned or otherwise loaded into the printer 110 for printing. The term indicia as used herein includes but is not limited to any combination of letters, words, text, numbers, symbols, diagrams, pictures, photographs, trademarks, and graphics, in any of a variety of colors.

Base Plate

Figure 2:
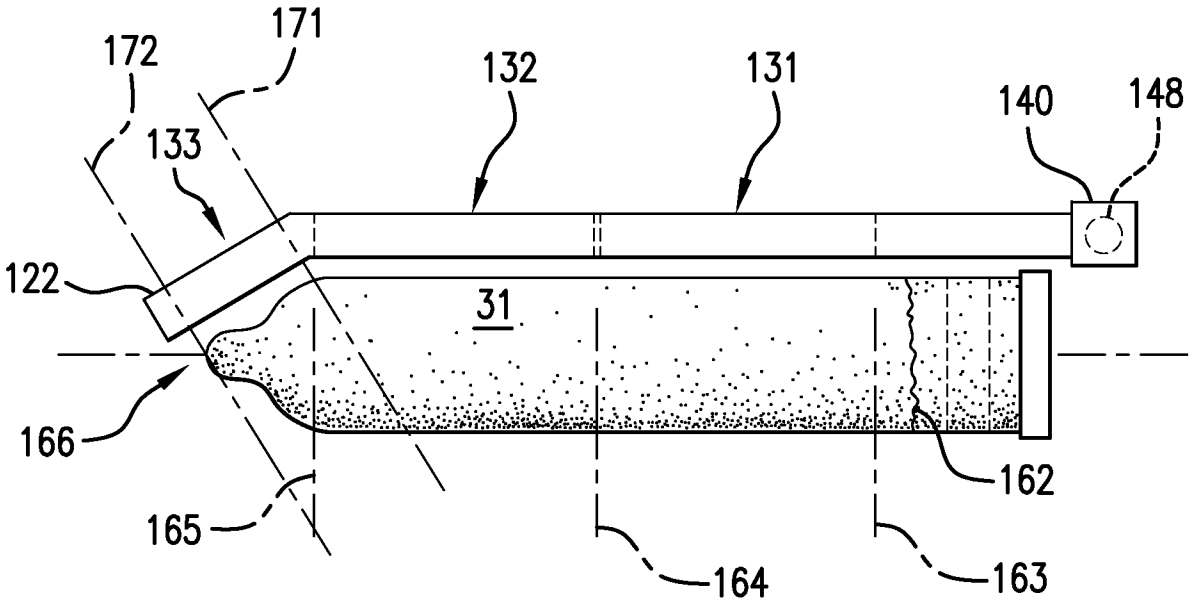
FIG. 2 is a side-view illustration of a glass mold and a base plate, according to various embodiments.

The printing system 100 in various embodiments may include a base plate 120 for supporting one or more print heads above a latex surface that will receive the printing. The base plate 120 may be generally planar in shape and, as illustrated in FIG. 2, may include a linear portion 121 and an angled portion 122. The linear portion 121 may be generally parallel to the longitudinal axis of the glass mold 10. The angled portion 122 may be oriented to closely conform to the size and shape of the bulbous end of the glass mold 10. The base plate 120 may be supported by a chassis 140 or other carriage that may be mounted to a servo rail 148, described below. FIG. 2 illustrates a first latex layer 31 deposited on the glass mold 10 which has an open end 162. The base plate 120 may include a set of openings or ports 130 that are sized and shaped to receive and support a set of print heads.

The embodiment illustrated in FIG. 2 includes a first port 131 and a second port 132 located in the linear portion 121, and a third port 133 located in the angled portion 122 of the base plate 120. As shown, the first port 131 may be positioned to support a print head such that it will print a portion of the desired indicia onto latex layer 31 that will span the area from approximately the proximal plane 163 to the intermediate plane 164. Similarly, the second port 132 may be positioned to support another print head such that it will print a portion of the desired indicia onto latex layer 31 that will span the area from approximately the intermediate plane 164 to the distal plane 165.

The third port 133, located in the angled portion 122 of the base plate 120, may be positioned to support another print head such that it will print a portion of the desired indicia onto latex layer 31 that will span the area from approximately the distal plane 165 to the end or tip point 166. The angled portion 122 may be characterized as having one or more reference planes, including a proximal angled plane 171 and a distal angled plane 172. As shown, the proximal angled plane 171 may intersect with the circumferential distal plane 165 near the uppermost surface of the distal end of the cylindrical body portion of the glass mold 10. The distal angled plane 172, as shown, may intersect with the tip point 166 of the glass mold 10.

Thus, the ports 131, 132, 133 and their respective print heads, described below, may be positioned to print indicia onto latex layer 31 that will form a substantially contiguous image, without overlapping, from a circumferential proximal plane 163 to the tip point 166.

Figure 3:
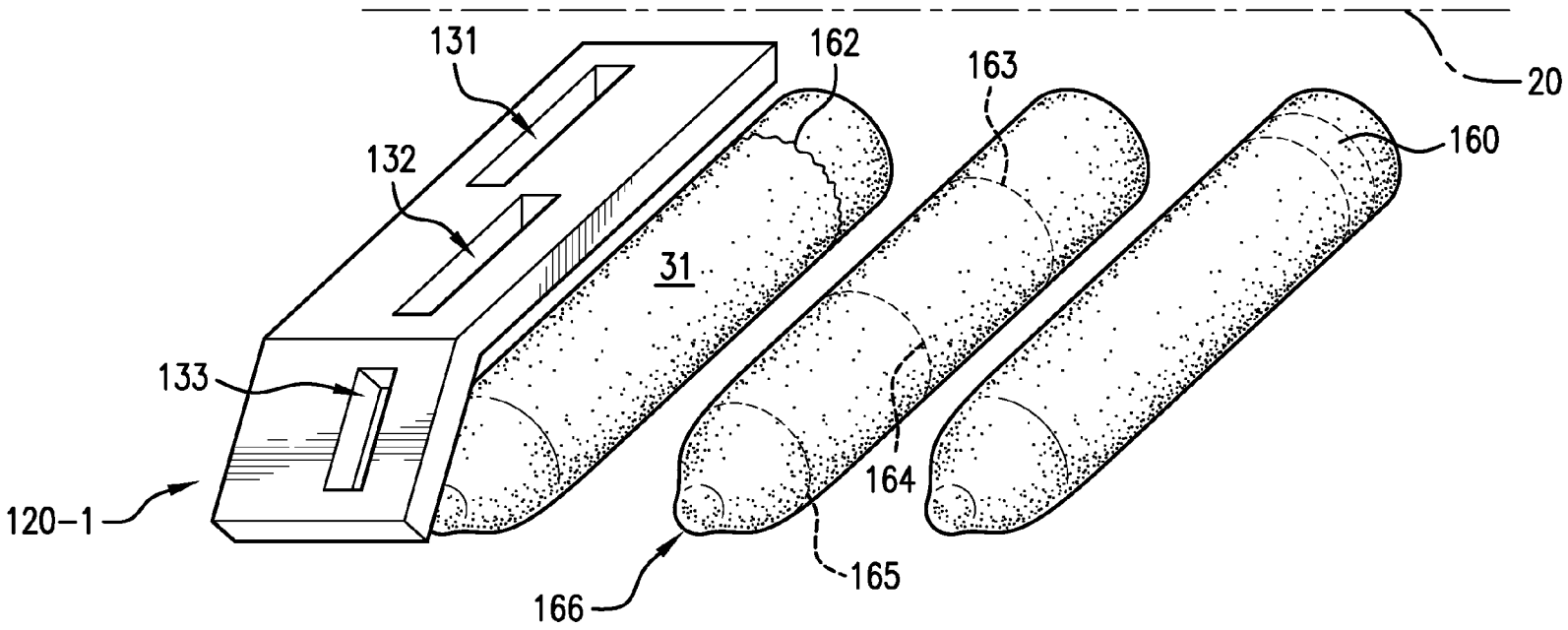
FIG. 3 is a perspective view illustration of glass molds and a base plate for supporting one set of print heads, according to various embodiments.

FIG. 3 is a perspective, schematic illustration of a base plate that is positioned above a plurality of glass molds 10 being driven along a dipping line 20. As shown, the base plate 120-1 includes one set of ports; a first port 131, a second port 132, and a third port 133. The ports 131, 132, 133 are oriented substantially parallel to the longitudinal axis of the glass molds 10, and generally perpendicular to the path of travel of the dipping line 20. The chassis 140 for supporting the base plate 120 is not shown. As shown, the first port 131 and second port 132 are transversely offset so that, when the print heads are positioned in their respective ports, there is no overlap in the printing delivered to the latex (specifically, at the circumferential intermediate plane 164). In this aspect, the printing system 100 may be used to print indicia onto substantially the entire surface of a latex layer 31, without overlapping, from a circumferential proximal plane 163 to the tip point 166.

Figure 4:
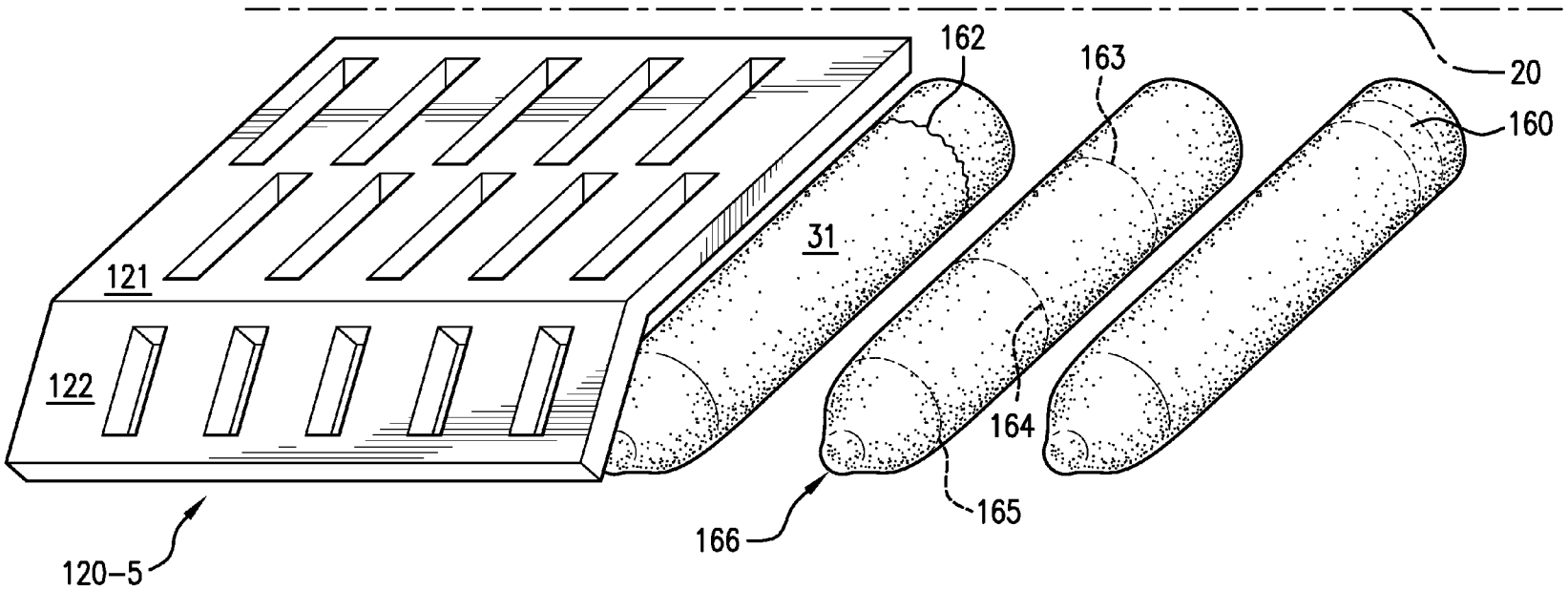
FIG. 4 is a perspective view illustration of glass molds and a base plate for supporting five sets of print heads, according to various embodiments.

FIG. 4 is a perspective, schematic illustration of a base plate 120-5 that includes five sets of ports, for printing on five different surfaces simultaneously. According to this embodiment, the five sets of ports may be spaced apart a distance that is approximately equal to the spacing between each glass mold 10 on the dipping line 20.

Print Heads

Figure 5:
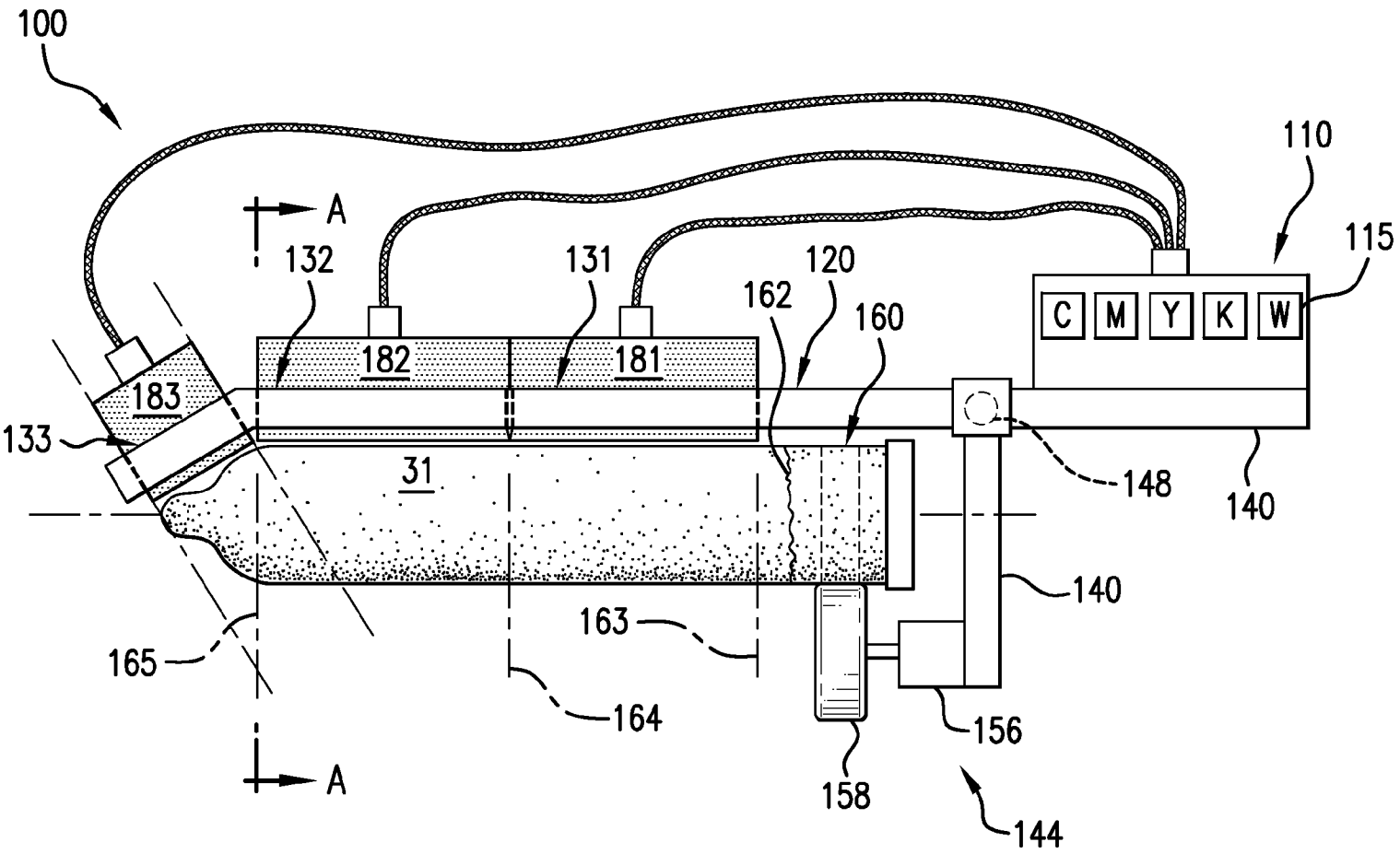
FIG. 5 is a side-view illustration of a glass mold, a base plate, a printer, and a rotational drive system, according to various embodiments.

FIG. 5 is a side-view illustration of a printing system 100 according to various embodiments. A set of print heads 180 may be supported by a base plate 120 that includes an opening or port for each print head. As shown, a first print head 181 may be received by a first port 131 in the base plate 120. A second print head 182 may be received by the second port 132, and the third print head 183 may be received by the third port 133. In the embodiment illustrated in FIG. 4, the base plate 120-5 may support fives sets of print heads.

The first print head 181 may be positioned to print a portion of the indicia that will span from approximately the proximal plane 163 to the intermediate plane 164 on the latex layer 31. The second print head 182 may be positioned to continue printing the indicia, from the intermediate plane 164 to the distal intermediate plane 165. Finally, the third print head 183 may be positioned on the angled portion 122 of the base plate 120 such that it will print the final portion of the indicia, from the distal intermediate plane 165 to the tip point 166.

The base plate 120 and its ports may be positioned near the glass molds 10 such that the face of each print head 181, 182, 183 is approximately three millimeters (plus or minus two millimeters) away from the latex layer 31 that will receive the printing. Although the latex layer 31 is not linear across the bulbous end 12 of the glass mold 10, the relatively close distance between the face of the third print head 183 and the latex surface prints indicia with acceptable clarity. The print heads may be oriented substantially perpendicular to the latex layer 31, and may be substantially fixed relative to the lengthwise longitudinal axis of the glass mold 10. For controlling the printing of indicia, each print head 180 may include a plurality of nozzles (not shown). In one embodiment, each print head 180 includes at least two rows of one hundred fifty nozzles. Each nozzle may be activated by the print controller 220 in a manner that is typical for an inkjet printer. For example, a droplet of ink may be jetted through each nozzle in a continuous or on-demand manner. Drop-on-demand printers deliver a drop of ink on-demand only when the print head receives a specific digital signal. The droplet of ink may be pushed through the nozzle by activation of a piezoelectric crystal.

Figure 7:
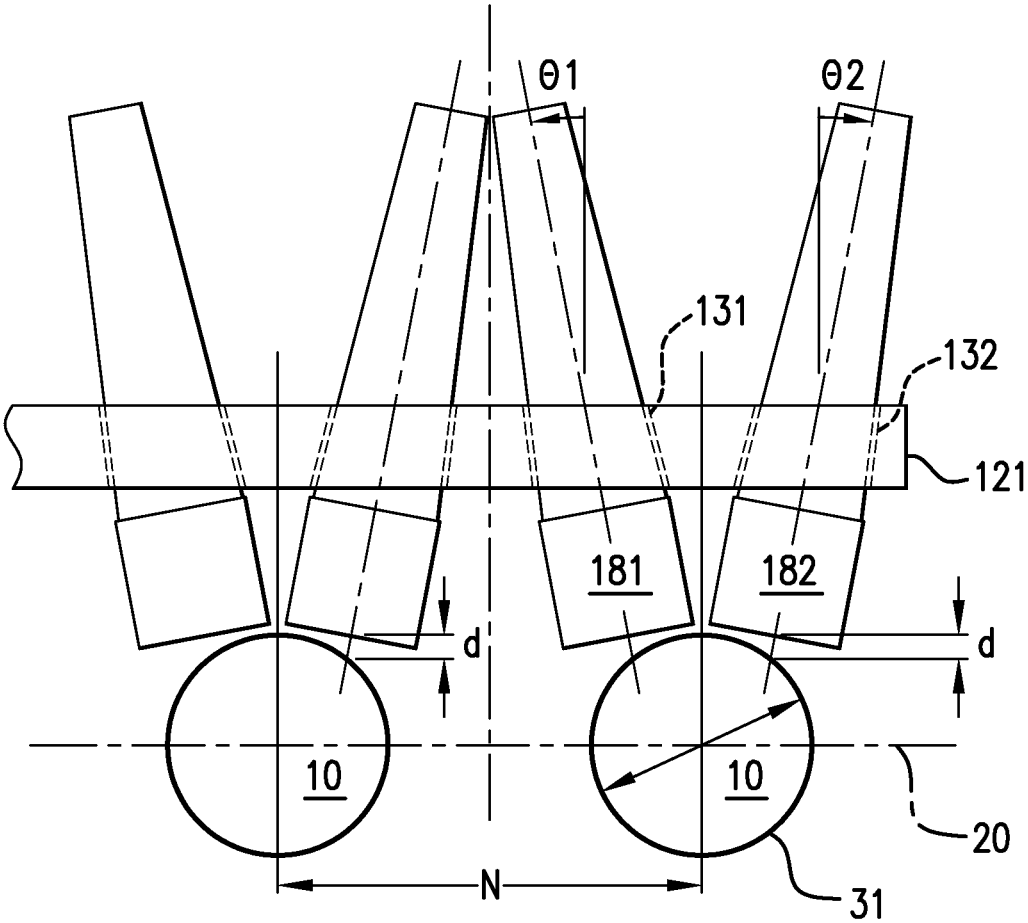
FIG. 7 is a sectional view of glass molds and printer heads, taken through A-A of FIG. 5, according to various embodiments.

The print heads 181, 182, 183 in various embodiments may be oriented in a generally vertical position or, alternatively, may be oriented at an angle so that the jet of ink is more perpendicular to the latex layer 31. FIG. 7 is a sectional illustration of the section A-A indicated in FIG. 5. FIG. 7 shows two glass molds 10 on a dipping line 20 spaced apart by a distance N which, in some embodiments, may be seventy millimeters. The print heads 181, 182 are supported by the linear portion 121 of a base plate. The print heads 181, 182 are positioned through the ports 131, 132, respectively, such that the clear distance between the rows of nozzles on each print head and the surface of latex layer 31 is a distance d which, in some embodiments, may be between about one millimeter to about five millimeters, plus or minus two millimeters. The first print head 181 may be oriented at a negative or counterclockwise angle θ1 with respect to a vertical axis, as illustrated in FIG. 7, which, in some embodiments, may be ten degrees. The second print head 182 may be oriented at a positive or clockwise angle θ2 with respect to a vertical axis, which, in some embodiments, may also be ten degrees. Compared to orienting the print heads 181, 182 in a vertical position, the print heads 181, 182 in this configuration are oriented such that the jet of ink travels in a direction that is nearer to perpendicular relative to the surface of the latex layer 31 receiving the ink.

Chassis

Referring again to FIG. 5, the printing system 100 in various embodiments may include a chassis 140 mounted on a servo rail 148 and driven by a linear motor (not shown). Because the glass molds 10 are in motion along the dipping line 20 during the printing process, the chassis 140 may be used to move the base plate 120 and its print heads along the servo rail 148 in order to accurately follow the glass molds during the print process.

The chassis 140 may be used to support the base plate 120, and/or the printer 110, and/or a rotational drive system 144 (described below). Each base plate 120 may include its own dedicated printer 110 and its own dedicated rotational drive system 144; all mounted on the same chassis 140. Alternatively, the printer 110 may be located at a fixed position near the dipping line 20 and not mounted to the moving chassis 140.

The velocity of the dipping line 10 is variable and may range from as slow as five to nine meters per minute, to as fast as twelve meters per minute. The printing system 100 described herein is compatible with a fast production line; for example, a line that produces fifty-eight to ninety imprinted items per minute.

Printer

The printer 110, as shown, may include a plurality of ink reservoirs 115. In one embodiment, the printer 110 includes five ink reservoirs 115; each containing cyan (C), magenta (M), yellow (Y), key (i.e., black) (K), and white (W) ink, respectively. In one embodiment, the printer 110 may include one set of three print heads 180 for each ink color, for a total of five sets. In this aspect, a first set of print heads would deliver cyan ink, a second set would deliver magenta ink, and so forth.

The printing system, in various embodiments, may use a latex-based ink that is approved for printing on medical devices and products. A condom, for example, may be classified in the U.S. and other jurisdictions as a non-sterile medical device that makes contact with the human body and bodily fluids. Accordingly, the printing system 100 may use a latex-based ink that is medically approved for use with such classified products. A latex-based ink may be selected that based on its viscosity, durability, and quick drying time (also referred to as "flash-off" time). In this aspect, a latex-based ink with a relatively quick drying time facilitates a good imprint with minimal or no smearing or smudging if and when a second latex layer is applied. Also, using a latex-based ink with a relatively quick drying time facilitates a clean manufacturing line because wet ink could potentially contaminate the latex in the second dip tank. In various embodiments, the latex-based ink may also contain one or more carrier agents designed to improve drying time. A latex-based ink may also be selected because the latex polymer in the ink minimizes any migration of the ink particles through any of the surrounding layers of latex. Latex-based inks are available in a full range of colors and are capable of producing clear, detailed, and intricate indicia.

The printer 110 may be supported by the chassis 140 that carries the base plate 120, so that it moves along with the base plate 120 during the print process. Alternatively, the printer 110 may be located at a fixed position near the dipping line 20 with flexible connections of sufficient length and flexibility to reach the print heads 180 on the moving base plate 120.

Rotational Drive System

The printing system 100 in various embodiments may include a rotational drive system 144, as shown schematically in FIG. 5. In one embodiment, the rotational drive system 144 may include a stepper motor 156 and a wheel or belt 158 that frictionally engages the proximal portion 160 of the glass mold 10 in order to rotate the glass mold 10 about its rotary mold mount 150 in a precise and controlled manner. The rotational drive system 144 may be mounted to the same chassis 140 as the base plate 120 or, alternatively, it may be mounted to its own separate chassis. In either case, the linear motion of the rotational drive system 144 along the dipping line 20 may be coordinated with the linear motion of the base plate 120.

The stepper motor 156 powers the wheel or belt 158 in order to rotate the glass molds 10 in the angular increment necessary to ensure that the nozzles deposit the jets of ink to form a contiguous image on the surface of the latex layer 31. The stepper motor 156, in particular embodiments, operates like the stepper motor in a paper printer that advances a sheet of paper, incrementally, around a cylinder or roller during printing. For an embodiment that includes printing on multiple latex surfaces simultaneously, the stepper motor 156 may power a belt 158 that is frictionally engaged against the proximal portions 160 of each of the glass molds supporting the latex surfaces selected for printing. The incremental linear motion of the belt 158, in turn, causes a proportional rotation of each glass mold 10 engaged by the belt 158. The rotational drive system 144 may also include an actuator (not shown) to move the belt 158 toward the glass molds 10 during a print process, and away from the glass molds 10 when the rotational drive system is in motion to another position along the dipping line 20.

Printer Engine

The printing system 100 in various embodiments may include a software program product referred to generally as a printer engine 200, which may be programmed to control all aspects of the print process. As illustrated schematically in FIG. 6, the printer engine 200 may include a motion controller 220 and a print controller 240.

The motion controller 220 may control the motion of the glass molds 10 along the path of the dipping line 20. The motion controller 220 may also be used to control the motion of a chassis 140, and to coordinate the motion of the chassis 140 with the motion of the glass molds 10. As described herein, the chassis 140 may support a base plate 120, a rotational drive system 144, and a printer 110.

The print controller 240 may control the stepper motor 156 and the print heads 180 during the print process. The print controller 240 also works to coordinate its operations with those of the motion controller 220.

Method of Printing Indicia

The printing system 100 described herein may be used in a method of printing indicia onto latex articles, such as condoms, during manufacture. In various embodiments, the printer 110 delivers ink onto a first layer 31 of latex. After printing, the indicia is allowed to dry and then may be covered by a second latex layer. The second layer provides a barrier that protects the indicia and prevents the ink from migrating through the second layer to the final exterior surface of the article. The step of applying a second layer substantially envelops, seals, and encapsulates the ink between the two layers of latex, thus minimizing leaching or migration of ink through the layers which, in turn, minimizes the unintended or incidental contact between with ink and the human body or bodily fluids.

In a first step, in various embodiments, the clean glass molds 10 may pass through a first dip tank to receive a first layer 31 of latex. The motion of the glass molds 10 along the dipping line may be controlled such that the first latex layer 31 is dried by traveling through the first oven and/or through the ambient air for a time that is long enough to dry the first layer 31. After the glass molds pass through a first oven or are otherwise dried, the first latex layer 31 is sufficiently dry to receive ink. A dry surface improves the ability of the first layer 31 to receive ink and thus results in clear indicia.

The motion controller 220 in particular embodiments controls the velocity of the glass molds 10 along a path called a dipping line 20. The motion controller 220 may also control the velocity of the base plate 120 on its chassis 140 in a direction that is substantially parallel to the dipping line 20. The base plate 120 in particular embodiments may be parked at a home position when not in active use. In a method of printing, the base plate 120 may be accelerated from its home position until it approximately matches the velocity of the glass molds 10, in preparation for printing to begin. This step positions the moving base plate 120 (and its print heads 180) substantially in line with the moving glass molds 10. When the velocity of the base plate 120 and the velocity of the molds 10 is approximately the same, the process of printing the indicia may begin.

The print controller 240 in particular embodiments controls the stepper motor 156, which drives the rotation of each glass mold 10. The print controller 240 also works to coordinate its operations with those of the motion controller 220, so that the rotational motion of the glass molds 10 is coordinated and synchronized with the linear motion of the glass molds 10 and base plate 120 along the dipping line 20. Simultaneously, the print controller 240 also controls the print heads 180 and the deposit of ink onto the latex. During printing, the print controller 240 controls the stepper motor 156 and the jetting of ink droplets through each nozzle in the array of nozzles on each print head. The stepper motor 156 pauses for a fraction of a second each time the print head jets a drop of ink onto the surface of the latex layer 31, and then rotates the glass mold 10 through a small incremental amount before pausing again. The pausing and incremental rotation typically occurs so fast that it may appear that the glass mold 10 is in nearly continuous rotation.

In particular embodiments such as those using a base plate 120-5 with five sets of print heads, as illustrated in FIG. 4, the moving base plate 120 may remain substantially stationary relative to the moving glass molds 10 on the dipping line 20, while each of the five sets of print heads are imprinting indicia onto five separate condoms simultaneously.

In other embodiments, such as those in which each set of print heads is dedicated to printing a single color, the base plate 120 may be moved linearly relative to the motion of the glass molds 10 on the dipping line 20 so that the desired set of print heads is aligned with the latex item to be imprinted. In this aspect, a single color may be printed on each of five separate condoms, followed by the next color, and so forth.

Referring again to FIG. 5, a typical dipping line includes a beading station where brushes are used to roll the open end 162 of the latex toward to the distal end of the glass mold 10, forming a circumferential bead or ring. In particular embodiments, the final bead may be located near the proximal plane 163 (where the printing of indicia starts). In this aspect, the indicia may begin at or near the final bead and continue across the entire length of the condom including the tip point 166.

In one embodiment, the printing system 100 includes three printers 110. The base plate 120 for each printer is spaced apart along the dipping line 20. In a system where the glass molds 10 are numbered sequentially, the three printers may be spaced apart so that each printer prints on every fourth condom. In this aspect, Printer One prints on molds 1, 4, 7, 10, etc. Printer Two prints on molds 2, 5, 8, 11, etc. Printer Three prints on molds 3, 6, 9, 12, etc. This spacing allows time for each base plate 120 to re-align itself and begin printing on the next glass mold, while the motion controller 220 continues to move the glass molds 10 along the dipping line 20.

In embodiments that include multiple printers, each printer 110 can be programmed to print different indicia. Each printer 110 can also be programmed to print different layers of the same indicia and/or make multiple passes across the latex in order to create a composite image.

After printing onto the first latex layer 31, the indicia may be allowed to dry. The motion of the glass molds 10 along the dipping line 20 may be controlled such that the indicia is dried by traveling through the ambient air for a time that is long enough to dry the ink. In combination with controlling the motion of the glass molds 10, the printing system 100 may use a latex-based ink with a relatively quick drying time. Allowing the ink to dry minimizes the occurrence of leaching or smudging during any later processing. Allowing the ink to dry also reduces the risk that the ink would contamination the latex in the second dip tank.

After the ink is dry, in particular embodiments, the glass molds 10 pass through a second dip tank for application of a second latex layer and then, optionally, through a second oven. The second layer may act to substantially contain the ink between the two layers and otherwise protects the indicia during later processing and handling; including, for example, the beading process and the stripping process during which the finished condoms are mechanically stripped off the glass molds 10.

In other embodiments, the glass molds 10 may pass through any number of subsequent dip tanks for an application of a subsequent layer of latex. In this aspect, an additional printer may be used to print additional indicia on any latex layer that will be covered by another latex layer during the process. Thus, for multi-layered latex products, there may be several imprinted indicia in the spaces between adjacent layers.

Conclusion

Although the systems, methods, and products are discussed in the context of latex condoms, the technology disclosed herein is also useful and applicable to condoms made of any of a variety of other materials, both natural and synthetic, including materials such as polyurethane, polyisoprene, and resins. The technology disclosed herein is also useful and applicable to other products, including but not limited to finger cots, surgical gloves, surgical drapes, household gloves, balloons, implantable and temporary catheters, bandages, dental cofferdams, adhesive tape, elastic bands, electrode pads, drains, all kinds of tubing and tips, rubber pads, fluid-circulating warming blankets, tourniquets, airways, breathing bags, all types of hoses and bellows, injection ports and intravenous tubing. For these and other uses, the indicia may include user guides, instructions, directions, warnings, and any combination of other indicia.

Although several embodiments have been described herein, those of ordinary skill in art, with the benefit of the teachings of this disclosure, will understand and comprehend many other embodiments and modifications for this technology. The invention therefore is not limited to the specific embodiments disclosed or discussed herein, and that may other embodiments and modifications are intended to be included within the scope of the appended claims. Moreover, although specific terms are occasionally used herein, as well as in the claims that follow, such terms are used in a generic and descriptive sense only, and should not be construed as limiting the described invention or the claims that follow.

The invention claimed is:

1. A system for printing indicia onto a surface, comprising:

a surface supported by a mold, wherein said mold is supported at its proximal end by a rotary mold mount that allows rotation about a longitudinal axis, and wherein said mold is driven along a first path at a first velocity;

a printer comprising one or more print heads and a printer engine;

a chassis supporting a base plate that is sized and shaped to extend along said surface, said base plate defining a plurality of ports therethrough, each sized and shaped to receive one of said one or more print heads;

a rotational drive system for selectively rotating said mold about said longitudinal axis; and a motion controller in communication with said printer engine, wherein said motion controller positions said base plate near said surface by moving said chassis to a location along said first path near said mold, wherein said printer engine activates said one or more print heads, in coordination with said rotational drive system, such that indicia is printed onto said surface.

2. The system of claim 1, wherein said rotational drive system comprises a stepper motor in communication with said printer engine.

3. The system of claim 2, wherein said mold comprises a substantially cylindrical body extending lengthwise about said longitudinal axis and further comprising a distal bulbous end, and wherein said printer engine activates said one or more print heads, in coordination with said rotational drive system, such that indicia is printed onto a substantially contiguous area of said surface, said substantially contiguous area defined by a circumferential border around said cylindrical body at a proximal plane and by said distal bulbous end.

4. The system of claim 3, wherein said base plate is substantially planar and comprises:

a linear portion extending along at least a portion of said substantially cylindrical body; and an angled portion extending from a distal end of said linear portion, and angled toward and extending along said distal bulbous end of said mold.

5. The system of claim 4, wherein said linear portion defines at least a first port for receiving a first print head and a second port for receiving a second print head, and wherein said angled portion defines at least a third port for receiving a third print head.

6. The system of claim 5, wherein said printer is an inkjet printer and wherein each of said first and second and third print heads comprises at least one row of nozzles for directing ink toward said surface, and wherein a clear distance between said surface and said at least one row of nozzles in each of said first and second and third print heads is a range from about one millimeters to about five millimeters.

7. The system of claim 5, wherein each of said first and second and third print heads is generally rectangular in shape and each is oriented with its longer side substantially parallel to said longitudinal axis, and wherein said first and second print heads are transversely offset relative to one another such that said first and second print heads together deliver ink to said substantially contiguous area of said surface.

8. The system of claim 7, wherein said first print head is vertically oriented at a first acute angle relative to a vertical axis that is substantially perpendicular to said longitudinal axis, and wherein said second print head is vertically oriented at a second acute angle relative to said vertical axis.

9. The system of claim 5, wherein said third port is positioned relative to said first and second ports such that said first and second and third print heads together deliver ink to said substantially contiguous area of said surface including said distal bulbous tip.

10. The system of claim 3, wherein said circumferential border is located near said rotary mold mount.

11. The system of claim 3, wherein said rotational drive system further comprises a belt driven by said stepper motor, wherein said belt is frictionally engaged with a proximal portion of said cylindrical body of said mold, and wherein said proximal portion is located between said rotary mold mount and said circumferential border.

12. The system of claim 1, wherein said chassis supports said rotational drive system.

13. The system of claim 1, wherein said chassis supports said printer.

14. The system of claim 1, wherein said printer further comprises one or more ink reservoirs, each containing a latex-based ink suitable for uses during which said ink may make contact with the human body.

15. The system of claim 1, wherein said printer further comprises a set of four or more ink reservoirs, each containing a single color selected from the group consisting of: cyan, magenta, yellow, key (black), and white.

16. The system of claim 1, further comprising a second surface, applied after said indicia is printed, and substantially covering said indicia, wherein said second surface is a material selected from the group consisting of latex, polyurethane, polyisoprene, and resin.

17. The system of claim 1, wherein said surface is a material selected from the group consisting of latex, polyurethane, polyisoprene, and resin.

18. The system of claim 1, wherein said motion controller further maintains said chassis at a second velocity during the printing of said indicia which is substantially equivalent to said first velocity of said mold.

19. A method of printing indicia onto a surface, comprising:

providing a mold for supporting a surface, wherein said mold is supported at its proximal end by a rotary mold mount that allows rotation about a longitudinal axis, and wherein said mold is driven along a first path at a first velocity;

providing a printer near said surface, said printer comprising one or more print heads and a printer engine;

positioning a chassis near said surface, said chassis supporting a base plate that is sized and shaped to extend along said surface, said base plate defining a plurality of ports therethrough, each sized and shaped to receive one of said one or more print heads;

selectively rotating said mold about said longitudinal axis using a rotational drive system;

positioning said base plate near said surface using a motion controller in communication with said printer engine to move said chassis to a location along said first path near said mold; and printing indicia onto said surface by activating said printer engine, in coordination with said rotational drive system.

20. The method of claim 19, wherein said mold comprises a substantially cylindrical body extending lengthwise about said longitudinal axis and further comprising a distal bulbous end, and wherein said step of printing indicia comprises printing said indicia onto a substantially contiguous area of said surface, wherein said substantially contiguous area is defined by a circumferential border around said cylindrical body at a proximal plane and by said distal bulbous end.

21. The method of claim 20, wherein said base plate is substantially planar and comprises:

a linear portion extending along at least a portion of said substantially cylindrical body; and an angled portion extending from a distal end of said linear portion, and angled toward and extending along said distal bulbous end of said mold.

22. The method of claim 21, wherein said linear portion defines at least a first port for receiving a first print head and a second port for receiving a second print head, and wherein said angled portion defines at least a third port for receiving a third print head.

23. The method of claim 22, wherein said printer is an inkjet printer and wherein each of said first and second and third print heads comprises at least one row of nozzles for directing ink toward said surface, and wherein said step of positioning said base plate comprises positioning said base plate such that a clear distance between said surface and said at least one row of nozzles in each of said first and second and third print heads is a range from about one millimeters to about five millimeters.

24. The method of claim 22, wherein each of said first and second and third print heads is generally rectangular in shape, and wherein said method further comprises:

orienting each of said first and second and third print heads with its longer side substantially parallel to said longitudinal axis; and transversely offsetting said first and second print heads relative to one another, such that said first and second print heads together deliver ink to said substantially contiguous area of said surface.

25. The method of claim 24, further comprising:

vertically orienting said first print head at a first acute angle relative to a vertical axis that is substantially perpendicular to said longitudinal axis; and vertically orienting said second print head at a second acute angle relative to said vertical axis.

26. The method of claim 22, further comprising:

positioning said third port relative to said first and second ports such that said first and second and third print heads together deliver ink to said substantially contiguous area of said surface including said distal bulbous tip.

27. The method of claim 20, wherein said rotational drive system comprises a belt driven by a stepper motor, and wherein said step of selectively rotating said mold comprises frictionally engaging said belt with a proximal portion of said cylindrical body of said mold, wherein said proximal portion is located between said rotary mold mount and said circumferential border.

28. The method of claim 19, further comprising applying a second surface, after said indicia is printed, wherein said second surface substantially covers said indicia, wherein said second surface is a material selected from the group consisting of latex, polyurethane, polyisoprene, and resin.

29. The method of claim 19, wherein said surface is a material selected from the group consisting of latex, polyurethane, polyisoprene, and resin.

30. The method of claim 19, wherein said step of positioning said base plate further comprises:

maintaining said chassis at a second velocity during said step of printing which is substantially equivalent to said first velocity of said mold.

* * * * *